US009926675B2

(12) United States Patent
MacDonald et al.

(10) Patent No.: US 9,926,675 B2
(45) Date of Patent: Mar. 27, 2018

(54) SURFACE COMPACTOR AND METHOD OF OPERATION

(75) Inventors: Michael P. MacDonald, Chambersburg, PA (US); Dale W. Starry, Jr., Shippensburg, PA (US)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 0 days.

(21) Appl. No.: 14/114,856

(22) PCT Filed: May 20, 2011

(86) PCT No.: PCT/US2011/037382
§ 371 (c)(1),
(2), (4) Date: Oct. 30, 2013

(87) PCT Pub. No.: WO2012/161679
PCT Pub. Date: Nov. 29, 2012

(65) Prior Publication Data
US 2014/0064850 A1 Mar. 6, 2014

(51) Int. Cl.
*E01C 19/28* (2006.01)

(52) U.S. Cl.
CPC ..... *E01C 19/28* (2013.01); *E01C 19/286* (2013.01)

(58) Field of Classification Search
CPC ..... E01C 19/286; E01C 19/288
USPC ..... 404/75, 84.1, 117
See application file for complete search history.

(56) References Cited

U.S. PATENT DOCUMENTS

| | | | | |
|---|---|---|---|---|
| 3,082,668 | A | | 3/1963 | Matson |
| 3,858,170 | A | * | 12/1974 | Freeman et al. ..... 367/13 |
| 3,922,589 | A | | 11/1975 | Peckingham |
| 3,979,715 | A | * | 9/1976 | Hufstedler et al. ..... 367/190 |
| 4,075,895 | A | | 2/1978 | Eyman |
| 4,149,253 | A | * | 4/1979 | Paar et al. ..... 701/50 |
| 4,330,738 | A | * | 5/1982 | Paramythioti et al. ..... 318/128 |
| 4,475,073 | A | | 10/1984 | Hawkins |
| 4,647,247 | A | * | 3/1987 | Sandstrom ..... 404/75 |
| 4,734,846 | A | * | 3/1988 | Konig ..... 700/33 |
| 4,927,289 | A | * | 5/1990 | Artzberger ..... 404/117 |
| 5,164,641 | A | | 11/1992 | Quibel et al. |
| 5,762,176 | A | | 6/1998 | Patterson et al. |
| 6,742,960 | B2 | | 6/2004 | Corcoran et al. |

(Continued)

FOREIGN PATENT DOCUMENTS

| | | |
|---|---|---|
| CN | 2403812 Y | 11/2000 |
| CN | 2435423 Y | 6/2001 |

(Continued)

OTHER PUBLICATIONS

Non-patent Google Patents translation of DE1634246A1.

(Continued)

*Primary Examiner* — Gary S Hartmann
(74) *Attorney, Agent, or Firm* — Michael Pruden

(57) ABSTRACT

The present invention relates to a surface compactor and a method of operating a surface compactor. The surface compactor is provided with at least one compacting surface for compacting a substrate an excitation system that generates a substantially square wave vibrational displacement or force that vibrates the least one compacting surface during compaction to increase the compaction rate of the substrate.

12 Claims, 5 Drawing Sheets

(56) References Cited

U.S. PATENT DOCUMENTS

| | | | | |
|---|---|---|---|---|
| 6,829,986 | B2 * | 12/2004 | Richter | B06B 1/161 100/155 R |
| 7,059,802 | B1 | 6/2006 | Geier et al. | |
| 7,354,221 | B2 | 4/2008 | Congdon | |
| 8,608,403 | B2 * | 12/2013 | Thiesse | 404/117 |
| 8,981,682 | B2 * | 3/2015 | Delson et al. | 318/114 |
| 2004/0045877 | A1 | 3/2004 | Rubie et al. | |
| 2006/0290662 | A1 | 12/2006 | Houston | |
| 2012/0232780 | A1 * | 9/2012 | Delson et al. | 701/400 |
| 2013/0229272 | A1 * | 9/2013 | Elliott | 340/407.2 |

FOREIGN PATENT DOCUMENTS

| | | | |
|---|---|---|---|
| CN | 2474591 | Y | 1/2002 |
| CN | 1587530 | A | 3/2005 |
| CN | 1676759 | A | 10/2005 |
| CN | 201165027 | Y | 12/2008 |
| DE | 1634246 | A1 | 7/1970 |
| EP | 0411349 | A1 | 2/1991 |

OTHER PUBLICATIONS

EPO Search Report dated Oct. 9, 2014 for corresponding EP application No. 11866259.2.
International Search Report and Written Opinion.
Translated CN Office Action with Search Report dated Apr. 1, 2015 for corresponding CN application No. 201180071023.6.

* cited by examiner

SURFACE COMPACTOR AND METHOD OF OPERATION

FIELD OF THE INVENTION

The present invention relates to a surface compactor provided with at least one compacting surface and an excitation system that generates a substantially square wave vibrational force that vibrates the at least one compacting surface.

BACKGROUND OF THE INVENTION

Surface compactors are used to compact a variety of substrates including asphalt and soil. Surface compactors are provided with one or more compacting surfaces for this purpose. By way of example, an asphalt paver may be provided with a compacting surface on a screed that at least partially compacts asphalt after it is deposited on a paving surface. By way of another example, a roller compactor may be provided with roller compacting surfaces for compacting soil, asphalt, or other materials.

In addition to relying on at least a portion of the mass of the surface compactor to generate a sufficient compacting force on the substrate, it is often times desirable to vibrate the compacting surface as the substrate is compacted. Those of ordinary skill in the art will appreciate that vibrating the compacting surface may increase compaction efficiency and compaction force, and thus decrease the time the surface compactor must be operated.

While many excitation systems have been developed for this purpose, in the context of roller compactors, the traditional method has involved a rotating eccentric mass. Those or ordinary skill in the art will appreciate that as the eccentric mass is rotated, an oscillating vibrational force is generated. Those of ordinary skill in the art will also appreciate that improvements of this basic design include using two eccentric masses, such as those disclosed in U.S. Pat. No. 3,909,147, to provide variable amplitude capabilities.

More recently, linear actuators, such as those disclosed in U.S. Pat. No. 6,742,960, have been proposed as a means for generating vibrations at two or more different frequencies, amplitudes, and phases. While practical for plate compactors, size constraints have made commercialization of linear actuators difficult in roller compactors, however.

While many of the proposed improvements in excitation systems have concerned variations involving amplitude, frequency, and phase, the present invention is directed to improving the shape of the waveform generated by the excitation system.

SUMMARY OF THE INVENTION

According to one embodiment of the present invention a surface compactor comprises at least one compacting surface for compacting a substrate and an excitation system that generates a substantially square wave vibrational displacement or force that vibrates the least one compacting surface.

According to another embodiment of the present invention a method of operating a surface compactor provided with at least one compacting surface for compacting a substrate and an excitation system that vibrates the at least one compacting surface comprises the step of using the excitation system to generate a substantially square wave vibrational displacement or force that vibrates the least one compacting surface and compacts the substrate.

ASPECTS OF THE INVENTION

According to one aspect of the present invention a surface compactor comprises at least one compacting surface for compacting a substrate and an excitation system that generates a substantially square wave vibrational displacement or force that vibrates the least one compacting surface.

Preferably, the surface compactor is a roller compactor provided with first and second rollers, the at least compacting surface includes first and second compacting surfaces located on an outer circumferential surface of the respective first and second rollers, the excitation system generates the substantially square wave vibrational displacement or force that vibrates the first compacting surface, and another excitation system generates another substantially square wave vibrational displacement or force that vibrates the second compacting surface Preferably, the excitation system further comprises a first exciter that generates a first sine wave vibrational force, a second exciter that generates a second sine wave vibrational force, and a third exciter that generates a third sine wave vibrational force and the first sine wave vibrational force, the second sine wave vibrational force, and the third sine wave vibrational force combine to generate the substantially square wave vibrational displacement or force.

Preferably, the excitation system further comprises a first exciter provided with a first eccentric mass and a first rotating shaft, wherein the first eccentric mass rotates with the first rotating shaft to generate a first sine wave vibrational force, a second exciter provided with a second eccentric mass and a second rotating shaft, wherein the second eccentric mass rotates with the second rotating shaft to generate a second sine wave vibrational force, and a third exciter provided with a third eccentric mass and a third rotating shaft, wherein the third eccentric mass rotates with the third rotating shaft to generate a third sine wave vibrational force and the first sine wave vibrational force, the second sine wave vibrational force, and the third sine wave vibrational force combine to generate the substantially square wave vibrational displacement or force.

Preferably, the excitation system further comprises a first exciter provided with a first eccentric mass and a first rotating shaft, wherein the first eccentric mass rotates with the first rotating shaft to generate a first sine wave vibrational force, a second exciter provided with a second eccentric mass and a second rotating shaft, wherein the second eccentric mass rotates with the second rotating shaft to generate a second sine wave vibrational force, a third exciter provided with a third eccentric mass and a third rotating shaft, wherein the third eccentric mass rotates with the third rotating shaft to generate a third sine wave vibrational force, and a geared belt driven drive system that applies torque to the first, second, and third shafts, to impart rotation to the first, second, and third shafts and the first, second and third eccentric masses, whereby the first sine wave vibrational force, the second sine wave vibrational force, and the third sine wave vibrational force combine to generate the substantially square wave vibrational displacement or force.

Preferably, the excitation system further comprises a first exciter provided with a first eccentric mass and a first rotating shaft, wherein the first eccentric mass rotates with the first rotating shaft to generate a first eccentric moment and a first frequency, a second exciter provided with a second eccentric mass and a second rotating shaft, wherein the second eccentric mass rotates with the second rotating shaft to generate a second eccentric moment and a second frequency, a third exciter provided with a third eccentric mass and a third rotating shaft, wherein the third eccentric mass rotates with the third rotating shaft to generate a third eccentric moment and a third frequency, wherein the ratio of the first eccentric moment to the second eccentric moment is 3 to 1, the ratio of the second frequency to the first frequency is 3 to 1, the ratio of the first eccentric moment to the third eccentric moment is 5 to 1, the ratio of the third frequency to the first frequency is 5 to 1, and the first sine wave vibrational force, the second sine wave vibrational force, and the third sine wave vibrational force combine to generate the substantially square wave vibrational displacement.

Preferably, the excitation system further comprises a first exciter provided with a first eccentric mass and a first rotating shaft, wherein the first eccentric mass rotates with the first rotating shaft to generate a first eccentric moment and a first frequency, a second exciter provided with a second eccentric mass and a second rotating shaft, wherein the second eccentric mass rotates with the second rotating shaft to generate a second eccentric moment and a second frequency, a third exciter provided with a third eccentric mass and a third rotating shaft, wherein the third eccentric mass rotates with the third rotating shaft to generate a third eccentric moment and a third frequency, wherein the ratio of the first eccentric moment to the second eccentric moment is 27 to 1, the ratio of the second frequency to the first frequency is 3 to 1, the ratio of the first eccentric moment to the third eccentric moment is 125 to 1, the ratio of the third frequency to the first frequency is 5 to 1, and the first sine wave vibrational force, the second sine wave vibrational force, and the third sine wave vibrational force combine to generate the substantially square wave vibrational force.

According to another aspect of the present invention, a method of operating a surface compactor provided with at least one compacting surface for compacting a substrate and an excitation system that vibrates the at least one compacting surface comprises the step of using the excitation system to generate a substantially square wave vibrational displacement or force that vibrates the least one compacting surface and compacts the substrate.

Preferably, the surface compactor includes another excitation system, the surface compactor is a roller compactor provided with first and second rollers, the at least compacting surface includes first and second compacting surfaces located on an outer circumferential surface of the respective first and second rollers, the step of using the excitation system to generate a substantially square wave vibrational displacement or force that vibrates the at least one compacting surface includes the step of using the excitation system to generate the substantially square wave vibrational displacement or force that vibrates the first compacting surface and compacts the substrate, and the method further comprises the step of using the another excitation system to generate another substantially square wave vibrational displacement or force that vibrates the second compacting surface and compacts the substrate.

Preferably, the excitation system further comprises a first exciter, a second exciter, and a third exciter and the step of using the excitation system to generate the substantially square wave vibrational displacement or force that vibrates the at least one compacting surface and compacts the substrate includes the steps of using the first exciter to generate a first sine wave vibrational force, using the second exciter to generate a second sine wave vibrational force, using the third exciter to generate a third sine wave vibrational force, and combining the first sine wave vibrational force, the second sine wave vibrational force, and the third sine wave vibrational force to generate the substantially square wave vibrational displacement or force.

Preferably, the excitation system further comprises a first exciter provided with a first eccentric mass and a first rotating shaft, a second exciter provided with a second eccentric mass and a second rotating shaft, and a third exciter provided with a third eccentric mass and a third rotating shaft and the step of using the excitation system to generate the substantially square wave vibrational displacement or force that vibrates the at least one compacting surface and compacts the substrate includes the steps of rotating the first eccentric mass and the first shaft to generate a first sine wave vibrational force, rotating the second eccentric mass and the second shaft to generate a second sine wave vibrational force, rotating the third eccentric mass and the third shaft to generate a third sine wave vibrational force, and combining the first sine wave vibrational force, the second sine wave vibrational force, and the third sine wave vibrational force to generate the substantially square wave vibrational displacement or force.

Preferably, the excitation system further comprises a first exciter provided with a first eccentric mass and a first rotating shaft, a second exciter provided with a second eccentric mass and a second rotating shaft, and a third exciter provided with a third eccentric mass and a third rotating shaft and the step of using the excitation system to generate the substantially square wave vibrational displacement or force that vibrates the at least one compacting surface and compacts the substrate includes the steps of using a geared belt driven drive system to rotate the first eccentric mass and the first shaft to generate a first sine wave vibrational force, using a geared belt driven drive system to rotate the second eccentric mass and the second shaft to generate a second sine wave vibrational force, using a geared belt driven drive system to rotate the third eccentric mass and the third shaft to generate a third sine wave vibrational force, and combining the first sine wave vibrational force, the second sine wave vibrational force, and the third sine wave vibrational force to generate the substantially square wave vibrational displacement or force.

Preferably, the excitation system further comprises a first exciter provided with a first eccentric mass and a first rotating shaft, a second exciter provided with a second eccentric mass and a second rotating shaft, and a third exciter provided with a third eccentric mass and a third rotating shaft and the step of using the excitation system to generate the substantially square wave vibrational displacement that vibrates the at least one compacting surface and compacts the substrate includes the steps of rotating the first eccentric mass and the first shaft to generate a first eccentric moment and a first frequency, rotating the second eccentric mass and the second shaft to generate a second eccentric moment and a second frequency, rotating the third eccentric mass and the third shaft to generate a third eccentric moment and a third frequency, selecting the ratio of the first eccentric moment to the second eccentric moment at 3 to 1, selecting the ratio of the second frequency to the first frequency at 3 to 1, selecting the ratio of the first eccentric moment to the third eccentric moment at 5 to 1, selecting the ratio of the third frequency to the first frequency at 5 to 1, and combining the first sine wave vibrational force, the second sine wave vibrational force, and the third sine wave vibrational force to generate the substantially square wave vibrational displacement.

Preferably, the excitation system further comprises a first exciter provided with a first eccentric mass and a first rotating shaft, a second exciter provided with a second eccentric mass and a second rotating shaft, and a third exciter provided with a third eccentric mass and a third rotating shaft and the step of using the excitation system to generate the substantially square wave vibrational force that vibrates the at least one compacting surface and compacts the substrate includes the steps of rotating the first eccentric mass and the first shaft to generate a first eccentric moment and a first frequency, rotating the second eccentric mass and the second shaft to generate a second eccentric moment and a second frequency, rotating the third eccentric mass and the third shaft to generate a third eccentric moment and a third frequency, selecting the ratio of the first eccentric moment to the second eccentric moment at 27 to 1, selecting the ratio of the second frequency to the first frequency at 3 to 1, selecting the ratio of the first eccentric moment to the third eccentric moment at 125 to 1, selecting the ratio of the third frequency to the first frequency at 5 to 1, and combining the first sine wave vibrational force, the second sine wave vibrational force, and the third sine wave vibrational force to generate the substantially square wave vibrational force.

DETAILED DESCRIPTION OF THE INVENTION

Figure 1:
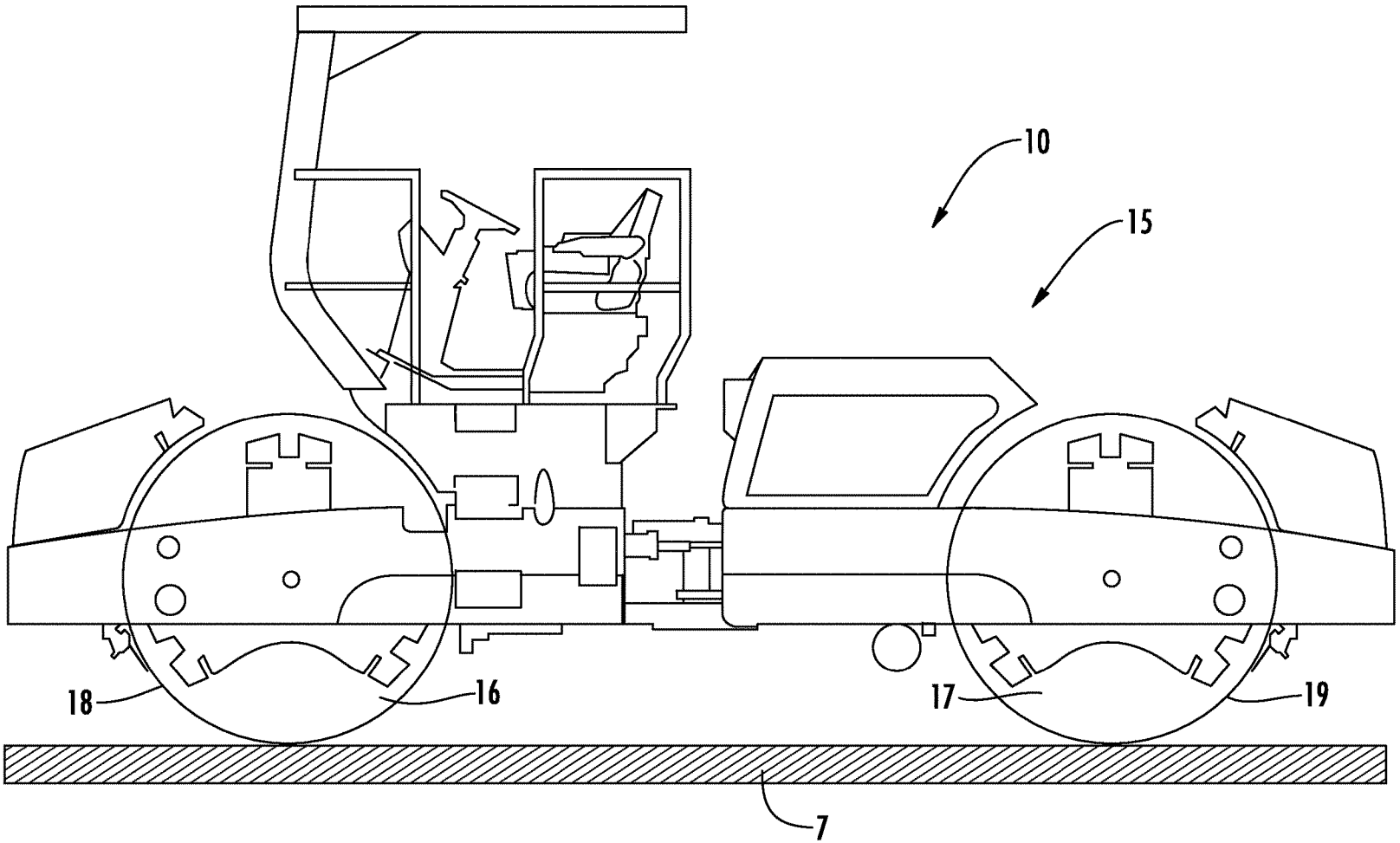
FIG. 1 illustrates a side view of a surface compactor according to one embodiment.

Turning now to FIG. 1, a surface compactor 10 according to one embodiment is depicted. As shown therein, the surface compactor 10 is a rolling compactor 15 provided with first and second rollers 16, 17. According to one aspect of the present invention, the rollers 16, 17 propel the rolling compactor 15 along a substrate 7 to be compacted, such as asphalt, earth, or rocks. According to another aspect of the present embodiment, the rollers 16, 17 are configured to apply a compaction force to the substrate 7.

As shown in FIG. 1, the rolling compactor is provided with compacting surfaces 18, 19 that are cylindrical in shape and located on the outer circumferential surface of the rollers 16, 17. Those of ordinary skill in the art will appreciate that as the rollers 16, 17 propel the rolling compactor 15 along the substrate 7 that the compacting surfaces 18, 19 exert a heavy compacting force on the substrate 7 in order to compact the substrate 7.

According to one aspect of the present embodiment, a vibrational force is applied to the compacting surfaces 18, 19. According to another aspect of the present embodiment, the compacting surfaces 18, 19 are vibrated to improve the compaction rate of the substrate 7.

Figure 2:
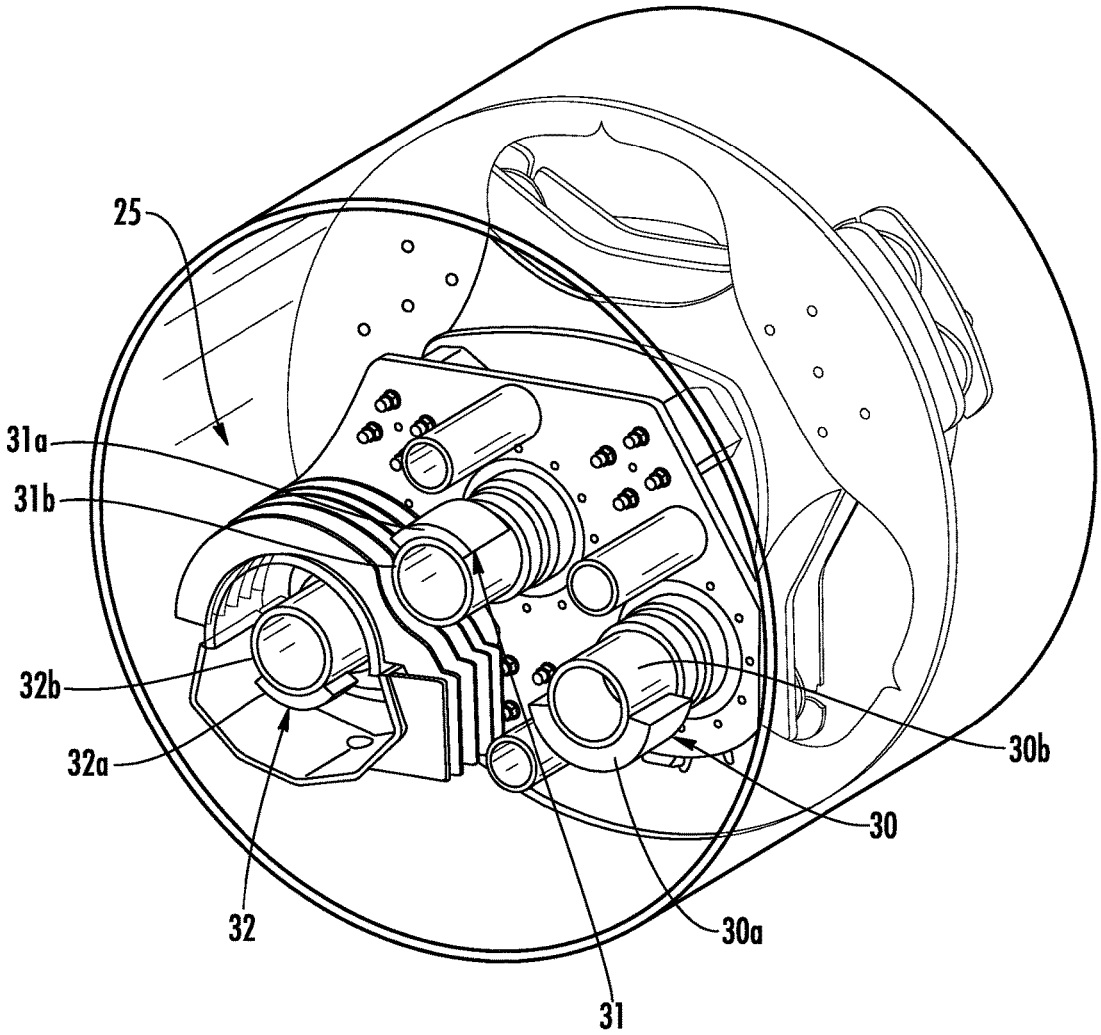
FIG. 2 illustrates a sectional view of a roller on a surface compactor and depicts a perspective view of an excitation system according to one embodiment.
Figure 3:
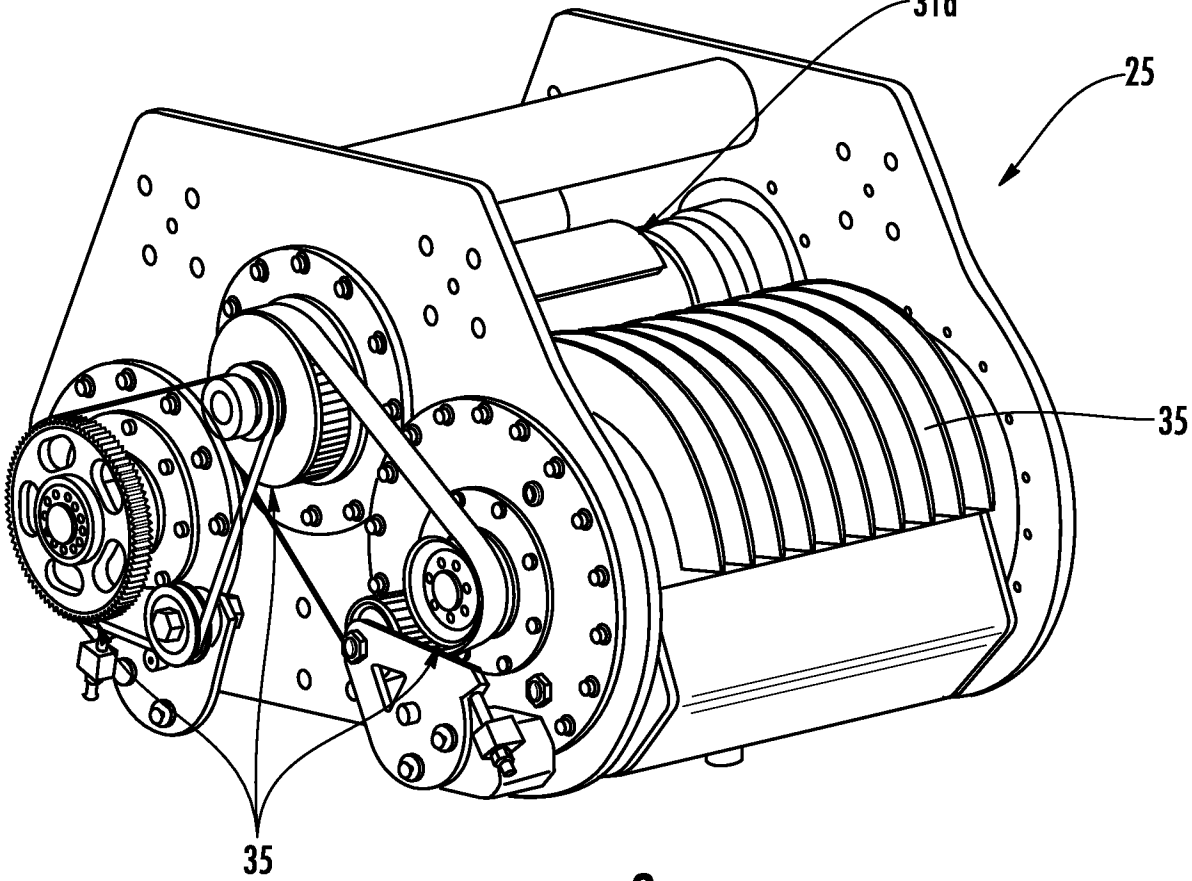
FIG. 3 illustrates a perspective view of an excitation system according to one embodiment.
Figure 4:
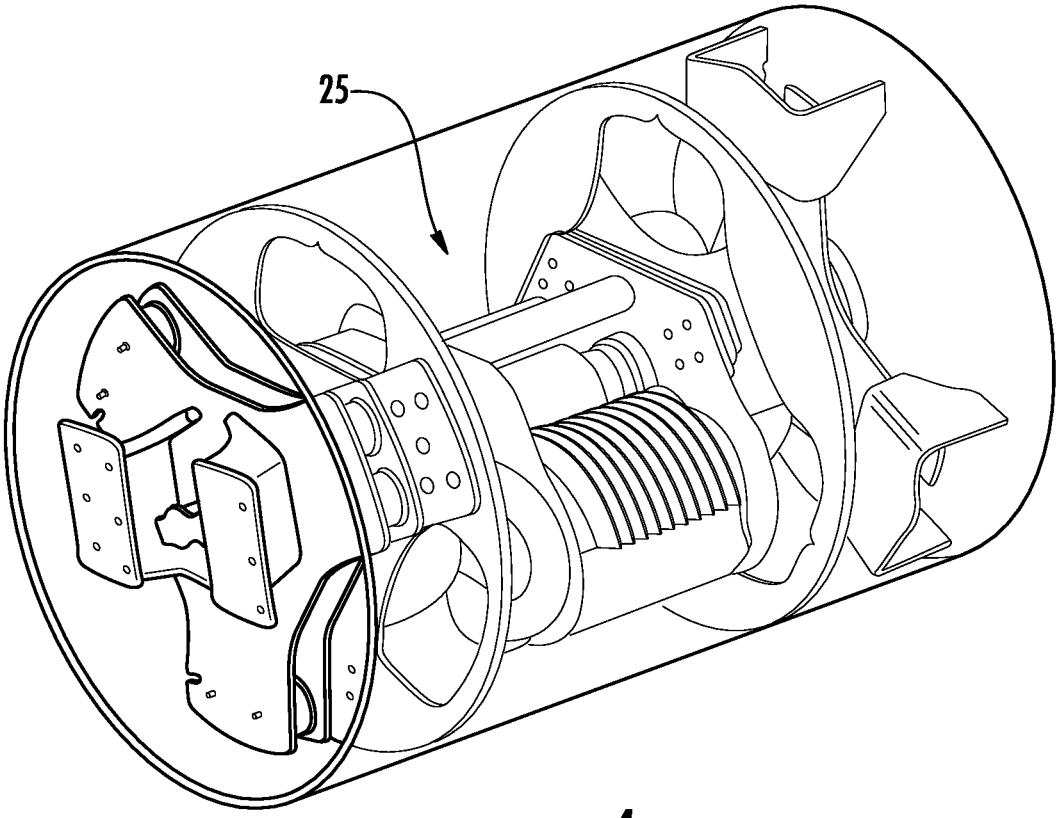
FIG. 4 illustrates a partially transparent view of a roller showing a perspective view of an excitation system according to one embodiment.

Turning now to FIGS. 2-4, as shown, the rolling compactor 15 includes an excitation system 25 located internally within each of the rollers 16, 17. According to one aspect of the present embodiment, the excitation system 25 includes a plurality of exciters, including a first exciter 30, a second exciter 31, and a third exciter 32. According to another aspect of the present embodiment, each exciter 30, 31, and 32 is provided with an eccentric mass 30*a*, 31*a*, or 32*a*. According to yet another aspect of the present embodiment, each exciter 30, 31, and 32 includes a rotating shaft 30*b*, 31*b*, or 32*b*.

According to another aspect of the present embodiment, the excitation system 25 includes drive system 35, which, by way of example, and not limitation, may be a geared belt driven system, as shown. According to one aspect of the present embodiment, the drive system 35 applies torque to the rotating shafts 30*b*, 31*b*, and 32*b* to impart rotation to the rotating shafts 30*b*, 31*b*, and 32*b*. According to another aspect of the present embodiment, the eccentric masses 30*a*, 31*a*, and 32*a* are mounted to the rotating shafts, 30*b*, 31*b*, and 32*b* and rotate therewith.

Those of ordinary skill in the art will appreciate that as the eccentric masses 30, 31, and 32 are rotated, a vibrational force is applied to the compacting surfaces 16, 17. In particular, those of ordinary skill in the art will appreciate that the eccentric masses 30*a*, 31*a*, and 32*a* generate respective eccentric moments $(me)_1$, $(me)_2$, and $(me)_3$. Those of ordinary skill in the art will appreciate that rotation of the eccentric masses 30*a*, 31, and 32 generates respective frequencies $\omega_1$, $\omega_2$, and $\omega_3$. Accordingly, the total vibrational force as a function of time t in a given direction can be determined according to the following equation:

$$F=(me)_1(\omega_1^2)\sin(\omega_1 t)+(me)_2(\omega_2^2)\sin(\omega_2 t)+(me)_3(\omega_3^2)\sin(\omega_3 t)$$

Advantageously, the excitation system 25 of the present embodiment is configured to generate a waveform that is non-sinusoidal. According to yet another aspect of the present embodiment, the excitation system 25 is configured to generate a vibrating waveform that is substantially square wave in shape.

Advantageously, by controlling the frequencies and eccentric moments generated by the rotating eccentric masses 30*a*, 31*b*, and 32*c*, a substantially square waveform may be generated by the excitation system 25. In particular, by selecting the appropriate eccentric moments and frequencies generated by the individual eccentric masses 30*a*, 31*b*, and 32*c*, a substantial square wave may be generated by the excitation system 25. By way of example, a square wave displacement can be produced by selecting the following frequency and eccentric moment ratios:

$(me)_1/(me)_2=\omega_2/\omega_1=3$ and $(me)_1/(me)_3=\omega_3/\omega_1=5$, where the heaviest eccentric mass is $(me)_1$, running at frequency $\omega_1$, the second heaviest eccentric mass is $(me)_2$, running at frequency $\omega_2$, and the third heaviest eccentric mass is $(me)_3$, running at frequency $\omega_3$.

By way of another example, a square wave force can be produced by selecting the following frequency and eccentric moment ratios:

$(me)_1/(me)_2=27$, $\omega_2/\omega_1=3$, $(me)_1/(me)_3=125$ $\omega_3/\omega_1=5$, where the heaviest eccentric mass is $(me)_1$, running at frequency $\omega_1$, the second heaviest eccentric mass is $(me)_2$, running at frequency $\omega_2$, and the third heaviest eccentric mass is $(me)_3$, running at frequency $\omega_3$.

Those of ordinary skill in the art will appreciate that the appropriate eccentric moment ratios may be achieved by providing the eccentric masses 30*a*, 31*a*, and 32*a* with different weights, as illustrated by the size difference of the masses 30*a*, 31*a*, and 32*a* shown in FIGS. 2-4. Those of ordinary skill in the art will appreciate that the appropriate frequency ratios may be achieved by rotating the shafts 30*b*, 31*b*, and 32*b* at different speeds, which, by way of example, and not limitation, may be achieved by the illustrated differently sized gears in the drive system 25 shown in FIG. 3.

Figure 5:
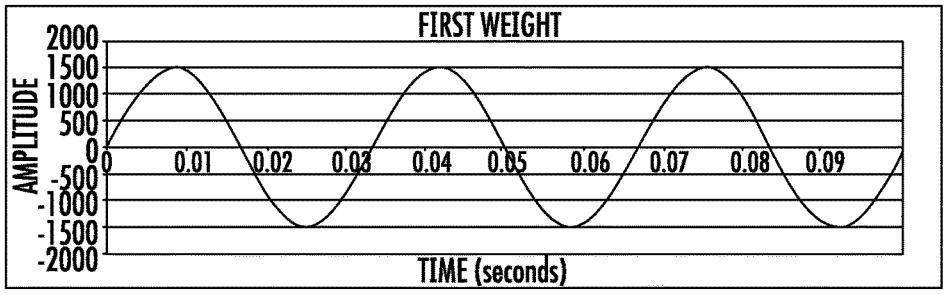
FIG. 5 illustrates a plot showing the vibration generated by a first exciter according to one embodiment.
Figure 6:
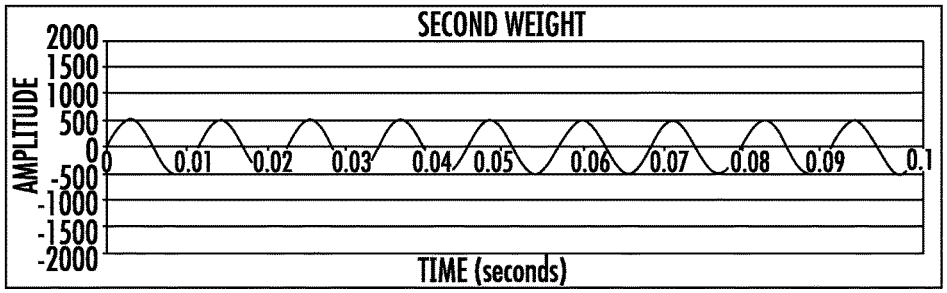
FIG. 6 illustrates a plot showing the vibration generated by a second exciter according to one embodiment.

By way of example, one or more electronics (not shown) may be used to control the rate of rotation of the heaviest mass 30*a* whereby a first sine waveform vibrational force is generated, as shown in FIG. 5. By way of example, the one or more electronics (not shown) may be used to control the rate of rotation of the second heaviest mass 31*a*, whereby a second sine waveform vibrational force is generated, as shown in FIG. 6. By way of example, the one or more electronics (not shown) may be used to control the rate of rotation of the least heaviest mass 32*a*, whereby a third sine waveform vibrational force is generated, as shown in FIG. 7.

Figure 7:
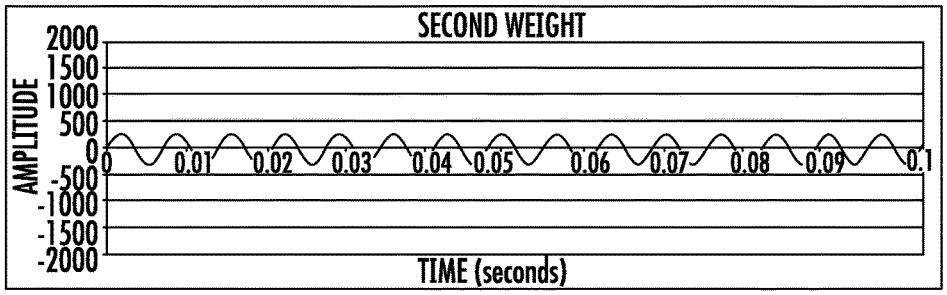
FIG. 7 illustrates a plot showing the vibration generated by a third exciter according to one embodiment.
Figure 8:
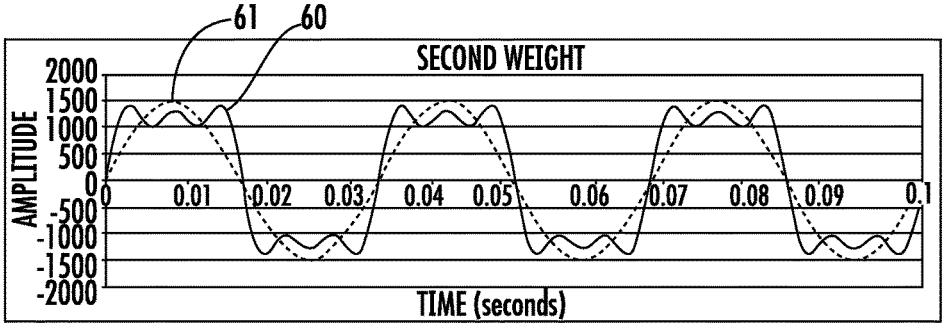
FIG. 8 illustrates a plot showing a combined substantially square wave vibration created by combining the vibrations generated by a first exciter, a second exciter, and a third exciter according to one embodiment.

Advantageously, as shown in FIG. 8, when the waveforms shown in FIGS. 5-7 are generated simultaneously, they combine to generate a cyclical substantially square wave 60 vibrational displacement that increases the amount of time at which the peak or near peak amplitude is applied to the compacting surfaces 16, 17, as compared to a traditional sine wave 61 vibrational force, per oscillation. Advantageously, increasing the amount of time at which the peak or near peak amplitude is applied to the compacting surfaces 16, 17, per oscillation, increases compaction efficiency and may reduce compaction time.

The detailed descriptions of the above embodiments are not exhaustive descriptions of all embodiments contemplated by the inventors to be within the scope of the invention. By way of example, although described in the context of a roller compactor 15, those of ordinary skill in the art will appreciate that it is within the scope of the present invention to apply the principals of the present embodiment to other types of surface compactors, including, but not limited to, plate compactors and asphalt pavers provided with a screed compacting surface. Furthermore, although described in the context of an excitation system 25 that employs eccentric masses 30*a*, 31*a*, and 32*a*, those of ordinary skill in the art will appreciate that the principals of the present invention may be applied to other types of excitation systems, including, but not limited to those that employ linear oscillators.

The present description depicts specific examples to teach those skilled in the art how to make and use the best mode of the invention. Those skilled in the art will appreciate variations from these examples that fall within the scope of the invention. Those of ordinary skill in the art will also appreciate that some conventional aspects have been simplified or omitted. By way of example, during rotation one or more of the masses 30*a*, 31*a*, or 32*a*, it may be desirable to associate the masses 30*a*, 31*a*, or 32*a*, particularly the lightest mass 32*a*, with a housing provided with cooling fins 33 or another arrangement that increase the amount of heat dissipated during rapid rotation.

Persons skilled in the art will recognize that certain elements of the above-described embodiments and examples may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention. Thus, although specific embodiments of, and examples for, the invention are described herein for illustrative purposes, various equivalent modifications are possible within the scope of the invention, as those skilled in the relevant art will recognize. Accordingly, the scope of the invention is determined from the appended claims and equivalents thereof.

We claim:

1. A surface compactor, comprising:

at least one compacting surface for compacting a substrate;

an excitation system that generates a substantially square wave vibrational displacement or force that vibrates the least one compacting surface and includes:

a first exciter that generates a first sine wave vibrational force;

a second exciter that generates a second sine wave vibrational force;

a third exciter that generates a third sine wave vibrational force; and the first sine wave vibrational force, the second sine wave vibrational force, and the third sine wave vibrational force combine to generate the substantially square wave vibrational displacement or force.

2. The surface compactor according to claim 1, wherein:

the surface compactor is a roller compactor provided with first and second rollers;

the at least compacting surface includes first and second compacting surfaces located on an outer circumferential surface of the respective first and second rollers;

the excitation system generates the substantially square wave vibrational displacement or force that vibrates the first compacting surface; and another excitation system generates another substantially square wave vibrational displacement or force that vibrates the second compacting surface.

3. The surface compactor according to claim 1, wherein:

the first exciter is provided with a first eccentric mass and a first rotating shaft, wherein the first eccentric mass rotates with the first rotating shaft to generate the first sine wave vibrational force;

the second exciter is provided with a second eccentric mass and a second rotating shaft, wherein the second eccentric mass rotates with the second rotating shaft to generate the second sine wave vibrational force; and the third exciter is provided with a third eccentric mass and a third rotating shaft, wherein the third eccentric mass rotates with the third rotating shaft to generate the third sine wave vibrational force.

4. The surface compactor according to claim 1, wherein:

the first exciter is provided with a first eccentric mass and a first rotating shaft, wherein the first eccentric mass rotates with the first rotating shaft to generate the first sine wave vibrational force;

the second exciter is provided with a second eccentric mass and a second rotating shaft, wherein the second eccentric mass rotates with the second rotating shaft to generate the second sine wave vibrational force;

the third exciter is provided with a third eccentric mass and a third rotating shaft, wherein the third eccentric mass rotates with the third rotating shaft to generate the third sine wave vibrational force; and a geared belt driven drive system that applies torque to the first, second, and third shafts, to impart rotation to the first, second, and third shafts and the first, second and third eccentric masses.

5. The surface compactor according to claim 1, the first exciter is provided with a first eccentric mass and a first rotating shaft, wherein the first eccentric mass rotates with the first rotating shaft to generate a first eccentric moment and a first frequency;

the second exciter is provided with a second eccentric mass and a second rotating shaft, wherein the second eccentric mass rotates with the second rotating shaft to generate a second eccentric moment and a second frequency;

the third exciter is provided with a third eccentric mass and a third rotating shaft, wherein the third eccentric mass rotates with the third rotating shaft to generate a third eccentric moment and a third frequency, wherein:

the ratio of the first eccentric moment to the second eccentric moment is 3 to 1;

the ratio of the second frequency to the first frequency is 3 to 1;

the ratio of the first eccentric moment to the third eccentric moment is 5 to 1; and the ratio of the third frequency to the first frequency is 5 to 1.

6. The surface compactor according to claim 1, the first exciter is provided with a first eccentric mass and a first rotating shaft, wherein the first eccentric mass rotates with the first rotating shaft to generate a first eccentric moment and a first frequency;

second exciter is provided with a second eccentric mass and a second rotating shaft, wherein the second eccentric mass rotates with the second rotating shaft to generate a second eccentric moment and a second frequency;

the third exciter is provided with a third eccentric mass and a third rotating shaft, wherein the third eccentric mass rotates with the third rotating shaft to generate a third eccentric moment and a third frequency, wherein:

the ratio of the first eccentric moment to the second eccentric moment is 27 to 1;

the ratio of the second frequency to the first frequency is 3 to 1;

the ratio of the first eccentric moment to the third eccentric moment is 125 to 1; and the ratio of the third frequency to the first frequency is 5 to 1.

7. A method of operating a surface compactor provided with at least one compacting surface for compacting a substrate and an excitation system that includes a first exciter, a second exciter and a third exciter and that vibrates the at least one compacting surface, comprising the step of:

using the excitation system to generate a substantially square wave vibrational displacement or force that vibrates the least one compacting surface and compacts the substrate, including the steps of:

using the first exciter to generate a first sine wave vibrational force;

using the second exciter to generate a second sine wave vibrational force;

using the third exciter to generate a third sine wave vibrational force; and combining the first sine wave vibrational force, the second sine wave vibrational force, and the third sine wave vibrational force to generate the substantially square wave vibrational displacement or force.

8. The method of operating a surface compactor according to claim 7, wherein the surface compactor includes another excitation system, the surface compactor is a roller compactor provided with first and second rollers, the at least compacting surface includes first and second compacting surfaces located on an outer circumferential surface of the respective first and second rollers, and the step of using the excitation system to generate a substantially square wave vibrational displacement or force that vibrates the at least one compacting surface includes the step of using the excitation system to generate the substantially square wave vibrational displacement or force that vibrates the first compacting surface and compacts the substrate, the method further comprising the step of:

using the another excitation system to generate another substantially square wave vibrational displacement or force that vibrates the second compacting surface and compacts the substrate.

9. The method of operating a surface compactor according to claim 7, wherein the first exciter is provided with a first eccentric mass and a first rotating shaft, the second exciter is provided with a second eccentric mass and a second rotating shaft, and the third exciter is provided with a third eccentric mass and a third rotating shaft and the step of using the excitation system to generate the substantially square wave vibrational displacement or force that vibrates the at least one compacting surface and compacts the substrate includes the steps of:

rotating the first eccentric mass and the first shaft to generate the first sine wave vibrational force;

rotating the second eccentric mass and the second shaft to generate the second sine wave vibrational force; and rotating the third eccentric mass and the third shaft to generate the third sine wave vibrational force.

10. The method of operating a surface compactor according to claim 7, wherein the first exciter is provided with a first eccentric mass and a first rotating shaft, the second exciter is provided with a second eccentric mass and a second rotating shaft, and the third exciter is provided with a third eccentric mass and a third rotating shaft and the step of using the excitation system to generate the substantially square wave vibrational displacement or force that vibrates the at least one compacting surface and compacts the substrate includes the steps of:

using a geared belt driven drive system to rotate the first eccentric mass and the first shaft to generate the first sine wave vibrational force;

using a geared belt driven drive system to rotate the second eccentric mass and the second shaft to generate the second sine wave vibrational force; and using a geared belt driven drive system to rotate the third eccentric mass and the third shaft to generate the third sine wave vibrational force.

11. The method of operating a surface compactor according to claim 7, wherein the first exciter is provided with a first eccentric mass and a first rotating shaft, the second exciter is provided with a second eccentric mass and a second rotating shaft, and the third exciter is provided with a third eccentric mass and a third rotating shaft and the step of using the excitation system to generate the substantially square wave vibrational displacement or force that vibrates the at least one compacting surface and compacts the substrate includes the steps of:

rotating the first eccentric mass and the first shaft to generate a first eccentric moment and a first frequency;

rotating the second eccentric mass and the second shaft to generate a second eccentric moment and a second frequency;

rotating the third eccentric mass and the third shaft to generate a third eccentric moment and a third frequency;

selecting the ratio of the first eccentric moment to the second eccentric moment at 3 to 1;

selecting the ratio of the second frequency to the first frequency at 3 to 1;

selecting the ratio of the first eccentric moment to the third eccentric moment at 5 to 1; and selecting the ratio of the third frequency to the first frequency at 5 to 1.

12. The method of operating a surface compactor according to claim 7, wherein the first exciter is provided with a first eccentric mass and a first rotating shaft, the second exciter is provided with a second eccentric mass and a second rotating shaft, and the third exciter is provided with a third eccentric mass and a third rotating shaft and the step of using the excitation system to generate the substantially square wave vibrational displacement or force that vibrates the at least one compacting surface and compacts the substrate includes the steps of:

rotating the first eccentric mass and the first shaft to generate a first eccentric moment and a first frequency;

rotating the second eccentric mass and the second shaft to generate a second eccentric moment and a second frequency;

rotating the third eccentric mass and the third shaft to generate a third eccentric moment and a third frequency;

selecting the ratio of the first eccentric moment to the second eccentric moment at 27 to 1;

selecting the ratio of the second frequency to the first frequency at 3 to 1;

selecting the ratio of the first eccentric moment to the third eccentric moment at 125 to 1; and selecting the ratio of the third frequency to the first frequency at 5 to 1.

* * * * *